United States Patent [19]

Asano et al.

[11] 4,403,875

[45] Sep. 13, 1983

[54] ARMATURE SUPPORT DEVICE OF A PRINT HEAD

[75] Inventors: Kiyomitsu Asano, Musashino; Toshikatsu Kondo, Nagoya; Masao Jozuka, Nagoya; Atsuo Sakaida, Nagoya, all of Japan

[73] Assignees: Brother Kogyo Kabushiki Kaisha, Aichi; Nippon Telecommunication Engineering Company, Tokyo, both of Japan

[21] Appl. No.: 323,694

[22] Filed: Nov. 20, 1981

[30] Foreign Application Priority Data

Nov. 25, 1980 [JP] Japan ..... 55-165492

[51] Int. Cl.[3] ..... B41J 3/12

[52] U.S. Cl. ..... 400/124; 101/93.05

[58] Field of Search ..... 400/124, 121; 101/93.04, 93.05, 93.48, 93.29–93.34; 335/274–276

[56] References Cited

U.S. PATENT DOCUMENTS 3,239,727 3/1966 Zupa ..... 335/276 X
3,842,955 10/1974 Iwasaki ..... 400/124
4,136,978 1/1979 Bellinger et al. ..... 400/124
4,167,343 9/1979 Golobay ..... 400/124

FOREIGN PATENT DOCUMENTS 1254388 11/1967 Fed. Rep. of Germany ..... 400/124

*Primary Examiner*—Paul T. Sewell
*Attorney, Agent, or Firm*—Browdy & Neimark

[57] ABSTRACT

An armature support device for rotatably supporting, in a print head, one end of an armature which holds a print wire at the other end thereof. The support device comprises a support member and a spring member. The spring member is made of a piece of a resilient wire, including a fixed portion of a hair pin shape to be secured to the armature, a pair of arm portions extending oppositely on the same axis from both ends of the fixed portion for functioning as a rotational fulcrum for the armature, a pair of leg portions further extending, by being perpendicularly bent, from both ends of the arm portions for being firmly fixed to the support member. The armature is biased toward a predetermined position by torsional resilient force of the arm portions of the spring member, and it is rotated about the arm portions by an electromagnetic device twisting the same to advance or restore the print wire.

12 Claims, 6 Drawing Figures

ARMATURE SUPPORT DEVICE OF A PRINT HEAD

BACKGROUND OF THE INVENTION

1. Field of Technology:

This invention relates to a print head in a dot matrix printer and more particularly to a support device for armatures respectively disposed in each of driving means for selectively driving a number of print wires provided in the print head.

2. Prior Art:

U.S. Pat. No. 4,136,978 discloses a support device for armatures with an object of improving the responding speed of the armature for enabling high speed printing of the print head. This device is however far from perfect due to its fundamental structure of supporting the armature by a pair of leaf springs arranged to cross each other almost perpendicularly, so that as the number of print wires increase, the number of parts in the print head increases. The resultant structure is thus more complicated, increased time and labor is needed for assembly thereof. In other words, the pair of leaf springs must be connected or joined at least at four points; that is to say, one end of each leaf spring is joined to the armature and the other end of each leaf spring is connected to the support member. The time and labor required to effect this joining operation in a print head having a large number of armatures is tremendous.

SUMMARY OF THE INVENTION

A primary object of this invention is to provide an inexpensive print head provided with an armature support device of simple structure requiring a small number of parts and capable of responding substantially equally to the printing speed in a print head having a support device according to U.S. Pat. No. 4,136,978.

In the armature support device according to the present invention a spring member made of a piece of resilient wire is used in place of the dual leaf-spring structure in the prior art. The spring member is provided with a fixed portion secured to the armature, a pair of coaxial, oppositely directed arm portions extending from the fixed portion and a pair of leg portions extending normal to, and in the same direction from, the arm portions.

This invention exhibits the capability of a high speed printing operation without an attendant random motion of the armature, is simple in structure, has a reduced number of parts, and is low in manufacturing cost because of easy assembly.

DETAILED DESCRIPTION OF THE PREFERRED EMBODIMENTS

Figure 1:
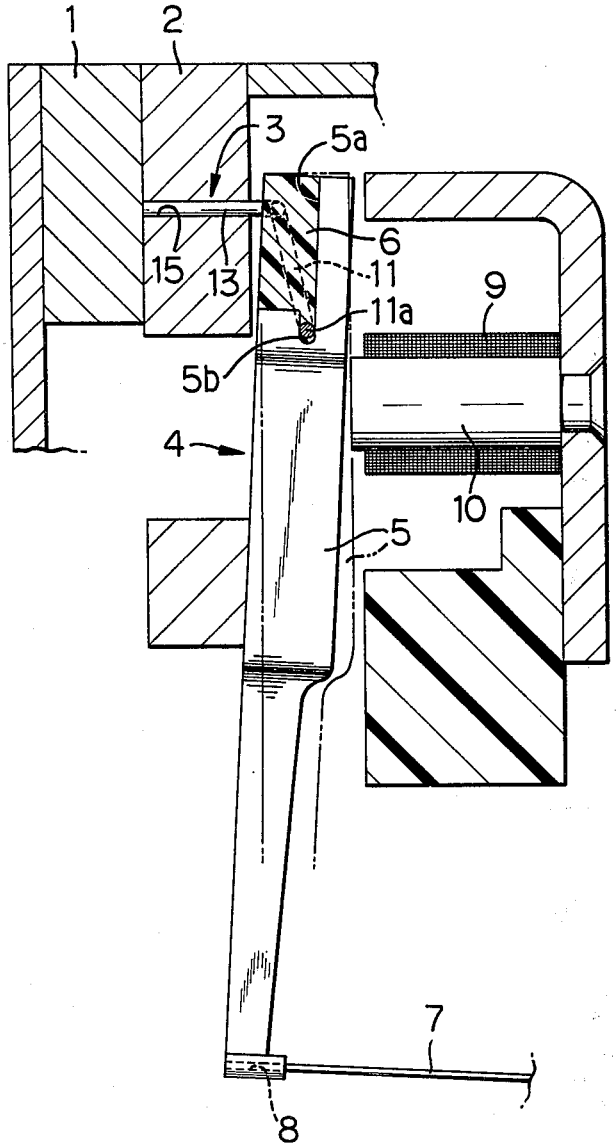
FIG. 1 is an elevation in section of a print head including an armature support device according to the present invention.

An embodiment of an armature support device of this invention realized in a print head for a dot matrix printer will now be described with reference to the appended drawings. On the external circumferential portion of a print head frame 1 an annular support member 2 is secured. On the front side, i.e., rightward side in FIG. 1, of the support member 2 a number of elongated armatures 4 are respectively rotatably a pivotably retained by way of a spring member 3, preferably comprising a wire spring, with the armatures 4 being arranged so as to extend radially from the support member 2 as shown in FIG. 2. Each of the armatures 4 is composed of a main portion 5 of a magnetic material and a base portion 6 of a synthetic resin material firmly fixed to the root end of the former (located adjacent spring member 3). In the root end of the main portion 5 there is formed a notch **5*a* and a slot 5*b* open to the notch 5*a*. The armature 4 is supported at the base portion 6 thereof by the spring member 3. A print wire 7 is secured in an aperture 8 formed on the free end portion of the armature 4**.

Figure 2:
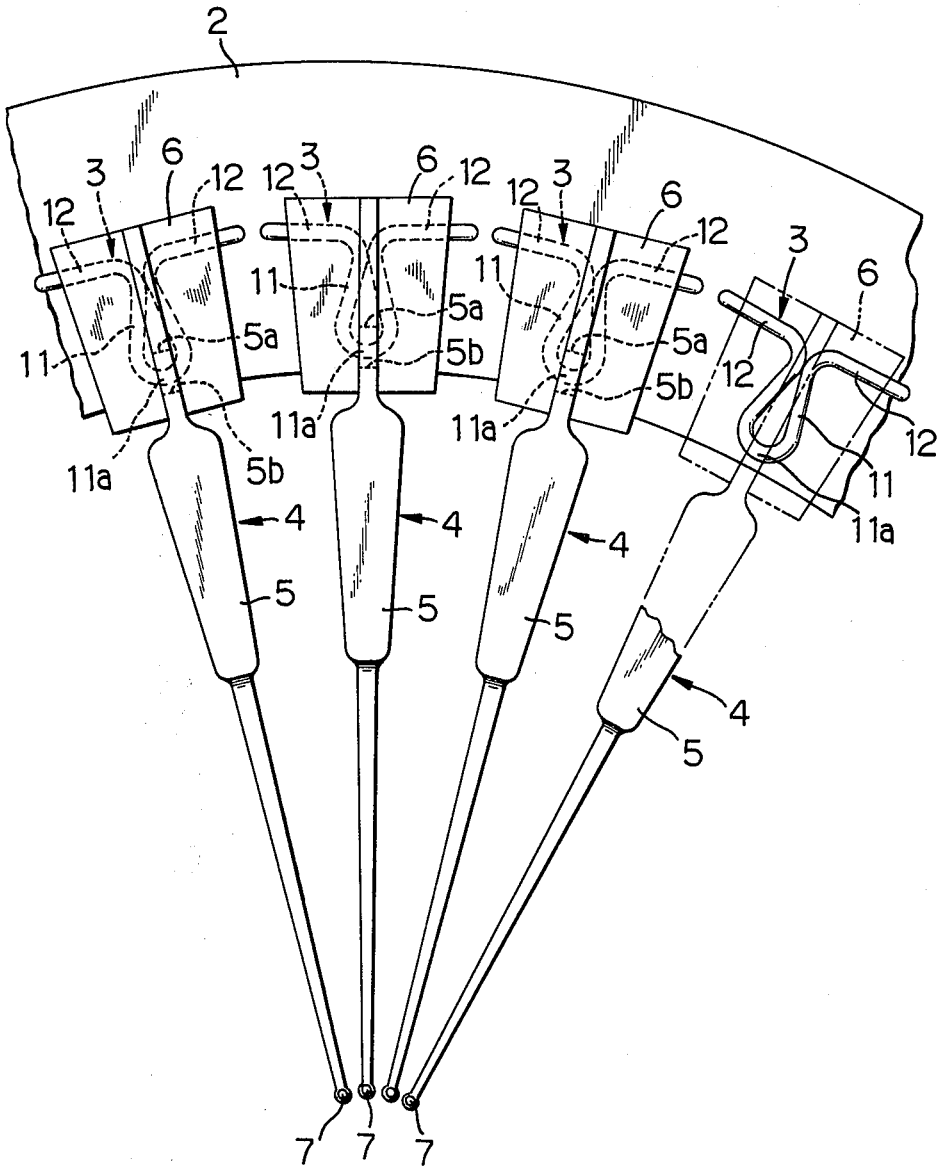
FIG. 2 is a view showing, in part, the arrangement of armatures in the print head.

The armature 4 is, in this embodiment, usually held in a non-operation posture, being placed at a position shown with a solid line in FIG. 1, due to the spring force of the spring member 3, wherein the print wire 7 is at rest and does not perform a printing operation. When an electromagnet 10, disposed face-to-face with the armature 4, is energized by current flowing through a coil 9 thereof, the armature 4 is forwardly rotated or pivoted about the bight position **11*a* of spring member 3 (see FIGS. 1 and 2) to the positon shown in phantom lines due to the generated magnetic force, resisting the spring force of the spring member 3, thus permitting printing via the print wire 7** to take place.

Each spring member 3, provided, respectively, for each armature 4, is composed of a hair pin like bent portion **11*a* made in the middle portion thereof, and forming a fixed portion 11 extending substantially along the longitudinal direction of the armature 4, a pair of coaxial arm portions 12 bent in opposite directions from, and extending normal to, the ends of fixed portion 11 so that the arm portions 12 are substantially perpendicular to the fixed portion 11 and extend away from each other, and a pair of leg portions 13 further bent, from one end of each of the arm portions 12 substantially perpendicularly to the longitudinal direction of the armature 4, toward the support member 2, all of the three portions 11, 12 and 13** being integrally formed.

Figure 3:
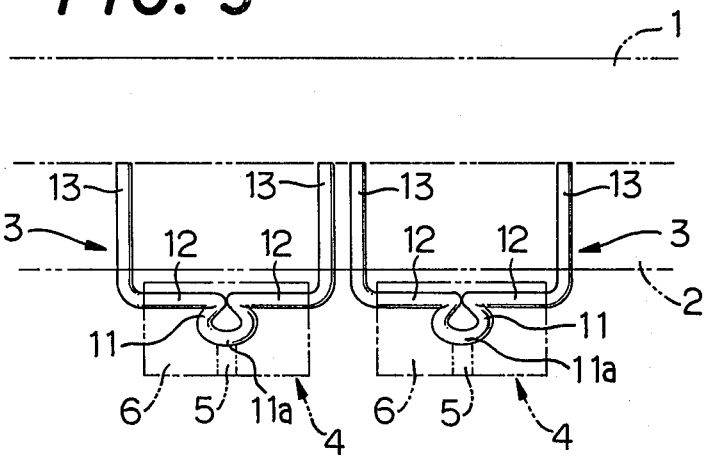
FIG. 3 is a plan view of a spring member used in the armature support device.
Figure 4:
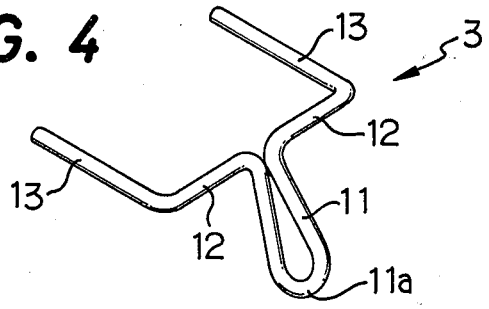
FIG. 4 is a perspective view of the spring member.

The fixed portion 11 of hair pin shape is securely imbedded in the base portion 6 of the armature 4, with the bent portion **11*a* in the middle thereof being inserted into the slot 5*b* of the main portion 5. The arm portions 12 are wholly disposed in, and relatively rotatably with, the base portion 6 in an imbedded manner except that only the outer end portions project out of the base portion 6. The armature 4 is rotatable or pivotable about the common axis of the arm portions 12. The relative rotation between the arm portions 12 and the base portion 6 is made possible by, when the base portion 6 is formed around the arm portions 12, applying some mold release agent on the external periphery of the arm portions 12. The leg portions 13 are in the greater part thereof firmly inserted respectively into an opening 15 formed in the support member 2 as clearly shown in FIGS. 3 and 5**.

The armature 4 is normally held at the solid line position in FIG. 1 due to the spring force of the arm portions 12, but when the electromagnet 10 is energized it is attracted by the electromagnet 10 and forwardly rotated or pivoted about the arm portions 12, with the fixed portion 11 also rotated or pivoted together with the armature 4 causing, in turn, torsion in the arm portions 12. When the armature 4 is rotated or pivoted like this, the leg portions 13 of the spring member 3 firmly inserted into the openings 15 of the support member 2, the arm portions 12 imbedded in the base portion 6 of the armature 4 which are allowed only to be twisted, and the fixed portion 11 engaged at the middle portion thereof with the main portion 5 of the armature 4 and imbedded in the base portion 6, can hardly be bent or buckled. The movement of the armature 4 is consequently limited only to the rotation or pivotal motion about the arm portions 12 so as to perform good printing operation without any random movement. When later the electromagnet 10 is deenergized the armature 4 is restored to the solid line position in FIG. 1 due to a torsional resilient force of the arm portions 12. In this restoring movement the armature 4 has a predetermined regular and accurate motion. With a print head provided with the armatures 4 supported in this way, high quality precise and rapid printing can be expected. Moreover, retaining or supporting of the armature 4 is achieved by the spring member 3 which is nothing but a piece of wire. It makes the structure extremely simple and the manufacturing cost very low.

Figure 5:
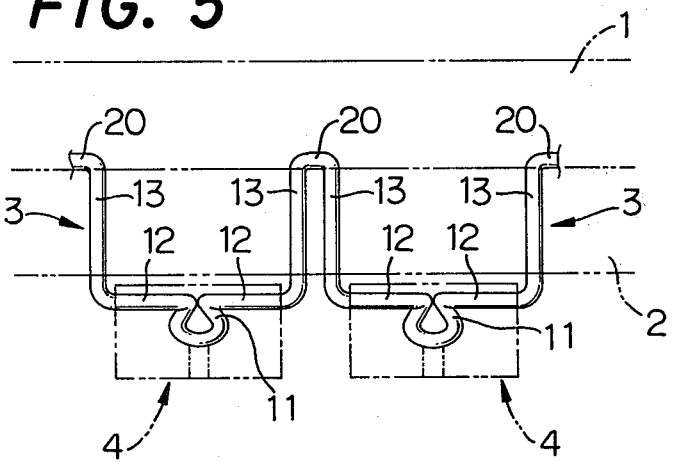
FIG. 5 is a plan view of a spring member used in another embodiment of the invention.

This invention can further be realized in the mode shown in FIG. 5 wherein, a plurality of spring members 3 may be made as a unit from a single piece of wire, with every two neighboring spring members 3 being linked with each other at the end of the leg portions 13 by a linking portion 20.

Figure 6:
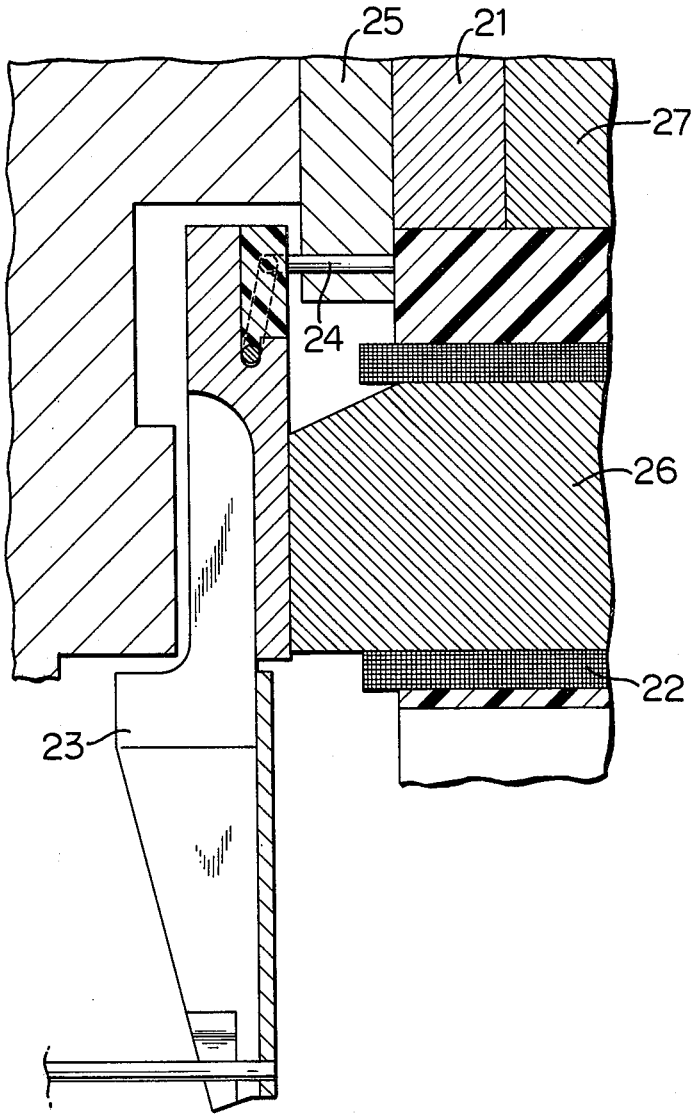
FIG. 6 is an elevation in section of another embodiment of the invention.

In place of a print head provided with an armature 4 which is rotated or pivoted when printing is carried out resisting the spring force of the spring member 3 due to energization of the electromagnet 10, as can be seen in the previous embodiment, this invention can be realized using another print head shown in FIG. 6 wherein magnetic force of a core portion 26 of a magnetic member 27 applied by a permanent magnet 21 is neutralized due to energization of a coil 22 for allowing the armature 23 which has been kept in attraction to the core portion 26 to do the printing operation due to the resilient force of a spring member 24 fixed to a support member 25. The structure of the spring member 24 is similar to that of the said spring member 3, with the exception that the biasing direction of the armature is inverted.

It is to be understood that the present invention is not limited to the above-mentioned embodiments, and that modifications and alterations may occur to those skilled in the art without departing from the scope of the following claims.

What is claimed is:

1. An armature support device of a print head pivotally supporting an armature at one end thereof, the armature holding a print wire at the other end thereof and having a base portion adjacent said one end, said support device comprising:

a support member; and a spring member made of a resilient wire material and including a fixed portion secured to said base portion of the armature, a pair of coaxial arm portions extending in opposite directions from said fixed portion, and a pair of leg portions extending from said coaxial arm portions respectively and fixed to said support member, said fixed portion and substantive parts of the arm portions being imbedded in said base portion of the armature such that said substantive parts of the arm portions are twistable in said base portion, said spring member normally holding said armature at a predetermined position, said fixed portion being pivotable together with said base portion about said arm portions which act as a pivoting fulcrum when said armature is pivoted away from said predetermined position, whereby said arm portions are twisted to produce thereon a torsional force acting to restore said armature to said predetermined position.

2. An armature support device in accordance with claim 1, wherein a plurality of said spring members are made of a single piece of wire, every two neighboring spring members being linked with each other at the tip of said arm portions by a linking portion.

3. An armature support device in accordance with claim 1, wherein said base portion of the armature is made of a synthetic resin material.

4. An armature support device in accordance with claim 1, wherein said leg portions extend from opposite ends of said coaxial arm portions respectively in a direction perpendicular to the longitudinal axis of the arm portions, said support member having openings through which substantive parts of said leg portions are firmly inserted to fix the leg portions to the support member.

5. A print head including a support head, a plurality of armatures each having a base portion at one end thereof, electromagnetic means for selectively driving said armatures, a print wire secured to the other end of each of said armatures, and a spring member pivotally connecting said one end of said each armature to said support member and made of a piece of resilient wire, said spring member comprising:

a fixed portion secured to said base portion of the armature;

a pair of coaxial arm portions extending in opposite directions from said fixed portion; and a pair of leg portions extending from said arm portions respectively and firmly fixed to said support member, said fixed portion and substantive parts of the arm portions being imbedded in said base portion of the armature such that said substantive parts of the arm portions are twistable in said base portion, said each armature being normally retained at a predetermined position by said spring member, said fixed portion being pivotable together with said base portion about said arm portions when said each armature is pivoted from said predetermined position about said arm portions which act as a pivoting fulcrum upon energization of said electromagnetic means, whereby said arm portions are twisted to produce thereon a torsional force for restoring said each armature to said predetermined position.

6. A print head including a support member, a plurality of armatures each having a base portion at one end thereof, an electromagnetic device having a permanent magnet and a coil and disposed so as to face said each armature for selectively driving the same, a print wire secured to the other end of said each armature, and a spring member pivotally connecting said one end of said each armature to said support member and made of a piece of resilient wire, said spring member comprising:

a fixed portion secured to said base portion of the armature;

a pair of coaxial arm portions extending in opposite directions from said fixed portion; and a pair of leg portions extending from said arm portions respectively and firmly fixed to said support member, said fixed portion and said substantive parts portions of the arm portions being imbedded in said base portion of the armature such that said substantive parts of the arm portions are twistable in said base portion, said each armature being normally retained at a predetermined position by magnetic force of said permanent magnet with said arm portions twisted to produce thereon a torsional force, said each armature being pivoted from said predetermined position to an operative position owing to said torsional force of said arm portions when said coil is energized to neutralize said permanent magnet.

7. An armature support device of a print head for pivotally supporting an elongated armature at one end thereof, the armature holding a print wire at the other end thereof and having a base portion adjacent said one end, said device comprising:

a support member; and a spring member made of a piece of resilient wire and including (a) a fixed portion of hair pin shape imbedded firmly in said base portion of said armature and extending in the longitudinal direction of the armature, (b) a pair of arm portions extending from both ends of said fixed portion in opposite directions along a common axis almost perpendicular to said fixed portion as far as to protrude outwards from opposite sides of said base portion of said armature, said arm portions being rotatable relative to said base portion about said common axis and functioning as a pivoting fulcrum of said armature, and (c) a pair of leg portions extending from opposite ends of said arm portions respectively in a direction substantially perpendicular to the longitudinal direction of said arm portions and firmly attached to said support member, said armature being normally retained at a predetermined position by said spring member, said fixed portion being pivotable together with said base portion about said common axis when said armature is pivoted from said predetermined position, whereby said arm portions are twisted to cause strain of torsion acting to restore said armature to said predetermined position.

8. An armature support device in accordance with claim 7, wherein said base portion of said armature is made of a synthetic resin material, said fixed portion and a substantive part of said each arm portion being imbedded in said base portion.

9. A print head including a support member, a plurality of armatures each having a base portion at one end thereof, an electromagnetic device having a permanent magnet and a coil and disposed so as to face said each armature for selectively operating said armature, a print wire secured to the other end of said armature, and a spring member pivotally connecting said one end of said armatures to said support member and made of a piece of resilient wire, said spring member comprising:

a fixed portion of hair pin shape firmly imbedded in said base portion of said armature and extending in the longitudinal direction of the armature;

a pair of arm portions extending from both ends of said fixed portion in opposite directions along a common axis almost perpendicular to said fixed portion as far as to protrude outwards from opposite sides of said base portion of said armature, said arm portions being rotatable relative to said base portion about said common axis; and a pair of leg portions extending from opposite ends of said arm portions respectively in a direction substantially perpendicular to the longitudinal direction of said arm portions and firmly attached to said support member, said armature being normally retained at a predetermined position by magnetic force of said permanent magnet with said arm portions of said spring member twisted to cause strain of torsion, said armature being pivoted from said predetermined position to an operative position by a torsional force produced by said strain of torsion when said coil is energized to neutralize said permanent magnet.

10. A print head in accordance with claim 9, wherein said base portion of said armature is made of a synthetic resin material, said fixed portion and a substantive part of said each arm portion being imbedded in said base portion.

11. An armature support device of a print head pivotally supporting a plurality of armatures at one end thereof, the armatures each holding a print wire at the other end thereof and having a base portion adjacent said one end, said support device comprising:

a support member; and a plurality of spring members made of a single piece of resilient wire including linking portions connecting said spring members to one another, each of said spring members including a fixed portion secured to said base portion of the armature, a pair of coaxial arm portions extending in opposite direction from said fixed portion, and a pair of leg portions extending from said coaxial arm portions respectively and fixed to said support member, said spring members normally holding the respective armatures at a predetermined rest position, said fixed portion being pivotable together with said armature about said pair of arm portions which act as a pivoting fulcrum when said armature is pivoted from said rest position, whereby said arm portions are twisted to produce thereon a torsional force acting to restore said armature to said rest position.

12. An armature support device in accordance with claim 11, wherein said base portion of said armature is made of a synthetic resin material, said fixed portion and a substantive part of said each arm portion being imbedded in said base portion.

* * * * *